US006296129B1

(12) United States Patent
Kawasaki

(10) Patent No.: US 6,296,129 B1
(45) **Date of Patent: *Oct. 2, 2001**

(54) METHOD FOR SHRINK-WRAPPING CONTAINERS AND ARTICLES OBTAINED THEREBY

(75) Inventor: Kazuhiko Kawasaki, Ramsey, NJ (US)

(73) Assignee: American Fuji Seal, Inc., Fairfield, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/715,300

(22) Filed: Sep. 16, 1996

(51) Int. Cl.[7] ..... B65D 1/02; B65D 23/08
(52) U.S. Cl. ..... 215/12.1; 215/12.2; 215/246
(58) Field of Search ..... 206/497; 215/12.1, 215/12.2, DIG. 6, 901, 249

(56) References Cited

U.S. PATENT DOCUMENTS

| | | | | |
|---|---|---|---|---|
| 2,790,285 | | 4/1957 | Pike et al. . | |
| 3,014,320 | * | 12/1961 | Harrison | 206/497 X |
| 3,110,554 | | 11/1963 | Yazumi . | |
| 3,235,112 | * | 2/1966 | Fillwalk et al. | 206/497 X |
| 3,604,584 | | 9/1971 | Shank, Jr. . | |
| 3,698,586 | | 10/1972 | Terner . | |
| 3,733,002 | * | 5/1973 | Fujio | 215/DIG. 6 X |
| 3,767,496 | | 10/1973 | Amberg et al. . | |
| 3,811,591 | * | 5/1974 | Novitch | 215/12.2 X |
| 4,011,122 | | 3/1977 | Ashcroft . | |
| 4,013,496 | | 3/1977 | Amberg . | |
| 4,016,706 | | 4/1977 | Braker et al. . | |
| 4,018,640 | | 4/1977 | Amberg . | |
| 4,034,131 | | 7/1977 | Rhoads . | |
| 4,051,265 | * | 9/1977 | Kirshenbaum et al. | 215/DIG. 6 X |
| 4,172,873 | | 10/1979 | Spicer . | |
| 4,248,030 | | 2/1981 | Heckman . | |
| 4,447,280 | | 5/1984 | Malthouse . | |
| 4,496,409 | | 1/1985 | Kontz . | |
| 4,544,073 | * | 10/1985 | Willis | 215/246 |
| 4,608,284 | * | 8/1986 | Roales | 215/12.2 X |
| 4,661,188 | | 4/1987 | Fumei . | |
| 4,923,557 | | 5/1990 | Dickey . | |
| 4,983,238 | | 1/1991 | Yoshida et al. . | |
| 5,186,988 | * | 2/1993 | Dixon | 206/497 X |
| 5,240,529 | | 8/1993 | Hoffman . | |
| 5,383,558 | * | 1/1995 | Wilkinson et al. | 206/497 X |
| 5,512,120 | | 4/1996 | Hinton et al. . | |
| 5,524,782 | * | 6/1996 | Salemi | 215/901 X |
| 5,605,230 | * | 2/1997 | Marino, Jr. et al. | 215/901 X |

* cited by examiner

*Primary Examiner*—Sue A. Weaver
(74) *Attorney, Agent, or Firm*—Pennie & Edmonds LLP

(57) ABSTRACT

The present invention relates to a method for wrapping a container having a neck portion and a body portion. The method uses a heat-shrinkable sleeve which has a perforation thereon. The sleeve is placed over the container, and heat is applied to the sleeve to cause the sleeve to shrink. The sleeve breaks at the perforation into a first and a second subsleeves which continue to shrink into snug surface engagement respectively with the neck portion and the body portion of the container. The present invention also relates to articles obtained by the method and the sleeve specifically designed for the method.

12 Claims, 2 Drawing Sheets

METHOD FOR SHRINK-WRAPPING CONTAINERS AND ARTICLES OBTAINED THEREBY

1. BACKGROUND OF THE PRESENT INVENTION

1.1 Technical Field

The present invention relates to a method of wrapping containers, and articles obtained by such a method. More particularly, the present invention relates to a method for shrink-wrapping two portions of a container simultaneously by using a wrapping material having a perforation thereon.

1.2 Description of Related Art

Heat-shrinkable films have been widely used to wrap containers. When a heat-shrinkable film is applied onto the body portion of a container, it usually serves several purposes. First, the heat-shrinkable film can be a protective means for the container preventing potential damage caused in handling the container. Second, it can be used as a label having a trademark or specification of the product printed thereon. When a film is formed on the neck portion of the container, it can also serve as a sealing means. This is needed especially when the container's contents are volatile or oxygen-sensitive, such as food and certain pharmaceutical products.

Conventional processes for forming a body wrap or a neck wrap generally involve forming the heat-shrinkable film into a sleeve slightly larger in diameter than the dimension of the portion of the container to be wrapped, placing the sleeve over the container, and heating the sleeve to shrink it onto the container. Typical wrapping processes are disclosed in U.S. Pat. Nos. 4,013,496, 4,016,706, 4,983,238, and 5,240,529.

In such typical processes, only one of the body portion and the neck portion of the container are wrapped. If both the body wrap and the neck wrap are to be formed on the same container, one possible approach is to form the two wraps separately in a sequential manner. However, there is a problem that the earlier-formed wrap may be overheated as it would have to be exposed to the heat applied to shrink the wrap to be formed later. Efficiency of the procedures and ease of operation would also be an issue of concern. None of the above-mentioned patents recognized these problems inasmuch as they relate either to the formation of a body wrap or the formation of a neck wrap. Therefore, it would be highly desirable if the two wraps can be formed on the container simultaneously in the same procedure.

2. SUMMARY OF THE PRESENT INVENTION

Accordingly, it is an object of the present invention to provide an efficient method for forming two heat-shrinkable wraps, one on the minor portion and the other on the major portion of a container simultaneously in a single procedure.

Another object is to provide an article comprising a container having a wrap on its minor portion and a wrap on its major portion formed by said method.

Yet another object is to provide a heat-shrinkable sleeve suitable for simultaneously wrapping the minor portion and the major portion of a container in a single procedures.

These and other objects of the present invention as well as the advantages thereof will be apparent from the following description and claims.

The present invention provides a method for wrapping a container having a minor portion and a major portion.

According to the method of the present invention, a heat-shrinkable sleeve having a perforation thereon is provided. The perforation is positioned such that, upon breakage of the perforation, the sleeve will be separated into a first subsleeve and a second subsleeve. The first subsleeve is adapted to wrap the minor portion of the container and the second subsleeve is adapted to wrap the major portion of the container. The perforation should be capable of breaking upon heating at a temperature to be applied to shrink the sleeve.

The sleeve is placed over the container in such a manner that, upon breakage of the perforation, the first subsleeve will encircle the minor portion of the container and the second subsleeve will encircle the major portion of the container.

Next, heat is applied to the sleeve sufficiently to cause the perforation to break due to shrinkage of the sleeve. The resulted first subsleeve and second subsleeve continue to shrink until they are in snug surface engagement respectively with the minor portion and the major portion of the container.

The present invention also provides an article obtained by the above method. The article comprises in combination a container having a minor portion and a major portion, and a first subsleeve wrapping the minor portion and a second subsleeve wrapping the major portion. The first subsleeve and the second subsleeve were connected as an integral sleeve through a perforation before being applied onto the container.

The present invention further provides a wrapping sleeve suitable for use in the above method. Accordingly, the sleeve has a perforation thereon positioned such that upon breakage of the perforation, the sleeve will be separated into a first subsleeve and a second subsleeve. The first subsleeve is adapted to wrap the minor portion of the container and the second subsleeve is adapted to wrap the major portion of the container.

In a preferred embodiment of the present invention, the minor portion of the container is a neck portion and the major portion of the container is a body portion. Preferably, the neck portion and the body portion are cylindrical.

In another preferred embodiment of the present invention, the sleeve is made of a heat-shrinkable material.

In yet another preferred embodiment of the present invention, at least one of the first subsleeve and the second subsleeve is a preprinted label.

In still another preferred embodiment of the present invention, the container is a plastic bottle or a glass bottle.

3. BRIEF DESCRIPTION OF THE DRAWINGS

Figure 4A:
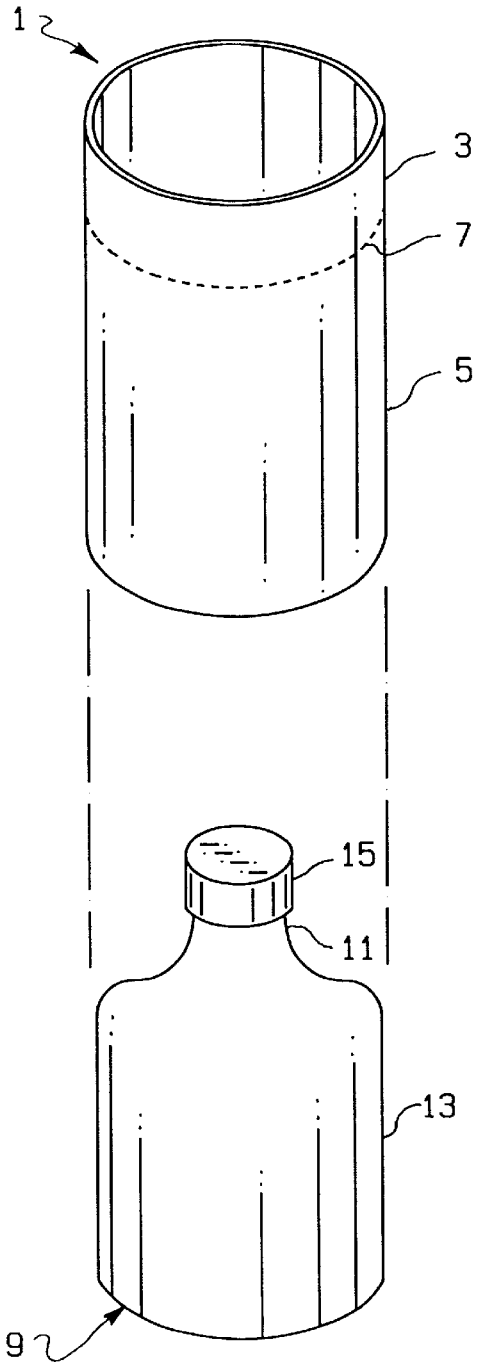
FIGS. 4A, 4B and 4C show the steps for carrying out a preferred embodiment of the present invention.
Figure 4B:
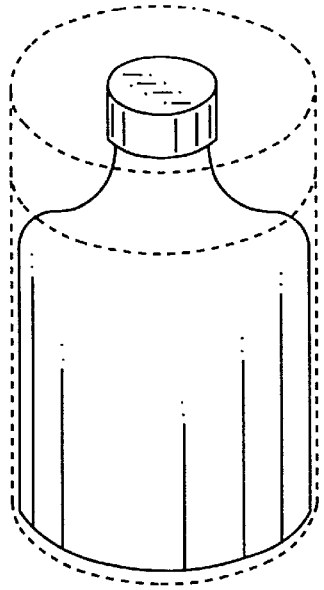
Figure 4C:
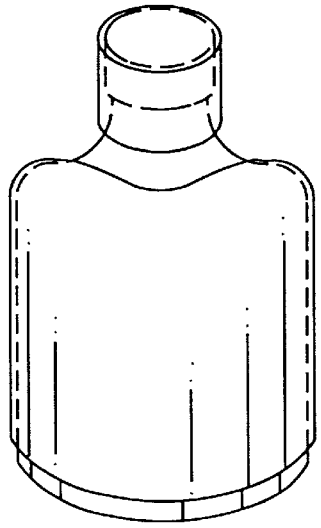

FIG. 4A shows a sleeve of the present invention before it is placed over a container. FIG. 4B shows the sleeve being placed over the container. FIG. 4C shows the sleeve breaking at a perforation and being separated into two subsleeves covering the neck portion and the body portion of the container.

4. DESCRIPTION OF THE PREFERRED EMBODIMENTS

Figure 1:
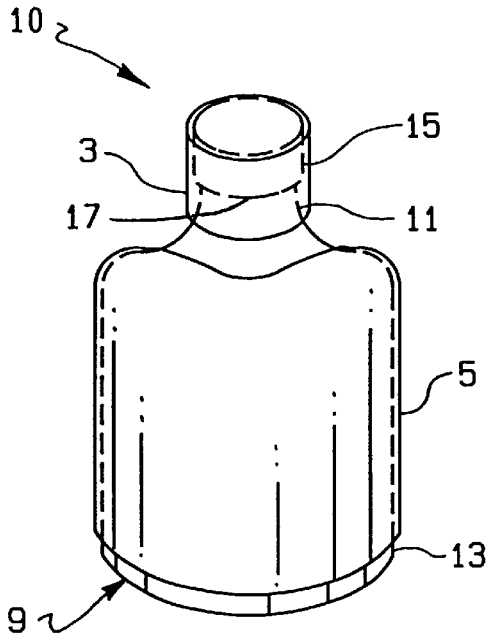
FIG. 1 shows a preferred embodiment of the article obtained according to the present invention.

Referring to FIG. 1, an article obtained according to the present invention is generally designated by numeral reference 10. The article 10 consists of a container 9 having a neck portion 11 and a body portion 13. A first subsleeve 3 is adapted to wrap around the neck portion 11 and a second subsleeve 5 around the body portion 13.

The present invention applies to virtually any containers 9 that call for wrappings on their different portions. Preferably, container 9 is a plastic or glass container used to contain pharmaceutical or food products. The container 9 can have two portions including a body portion 13 and a neck portion 11. In a preferred embodiment, the body portion 13 is of major dimension and the neck portion 11 is of minor dimension. The neck portion 11 and/or the body portion 13 are preferably cylindrical in shape. The container 9 can have an opening (not shown) at the neck portion 11. A closure 15 can be used to cap the opening.

The subsleeves 3 and 5 can serve various purposes. For example, they can function as a protective wrap of the container 9 preventing the container 9 from damage during shipment. The first subsleeve 3 on the neck portion 11 of the container 9 can also function as an airtight or hermetic sealing means. In a preferred embodiment, the first subsleeve 3 and/or the second subsleeve 5 can be a preprinted label. In this case, the first subsleeve 3 is preferably long enough to cover the skirt edge 17 of the closure 15 as shown in FIG. 1. The first subsleeve 3 and the second subsleeve 5 are preferably made of a heat-shrinkable material, such as a heat-shrinkable plastic material.

Figure 2:
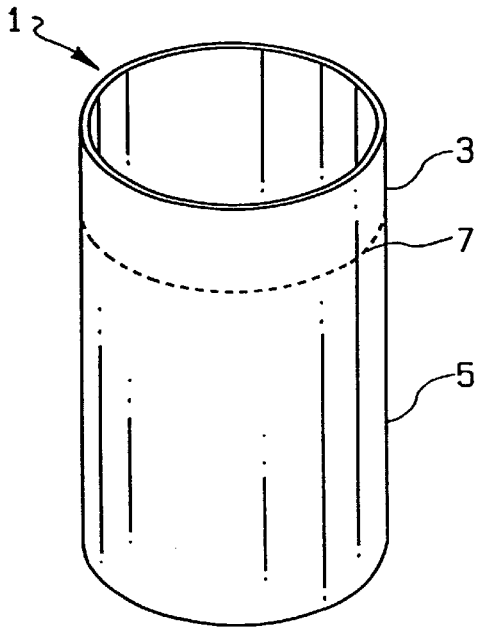
FIG. 2 shows a preferred embodiment of the wrapping sleeve of the present invention.

FIG. 2 shows a sleeve 1 according to the present invention. The sleeve 1 is composed of a first subsleeve 3 and a second subsleeve 5 connected by a perforation 7. The sleeve 1 is preferably made of a heat-shrinkable plastic material, e.g., a heat-shrinkable plastic material. Generally, the sleeve 1 should have an internal diameter slightly larger than the major dimension of the container 9 and a height substantially corresponding to the exterior height of the container 9. Therefore, with appropriate positioning of the perforation 7, the first subsleeve 3 and the second subsleeve 5 will each be capable to cover substantially the neck portion 11 or body portion 13 of the container 9. As described above, the first subsleeve 3 and/or the second subsleeve 5 can be a preprinted label.

The perforation 7 on the sleeve 1 can be in various patterns. The perforation 7 is designed so that it can be broken when the sleeve 1 is heat shrunk onto the container 9. As a result, the sleeve 1 is separated as the first subsleeve 3 and the second subsleeve 5. In a preferred embodiment, a circumferential perforation 7 is formed on the sleeve 1.

Figure 3:
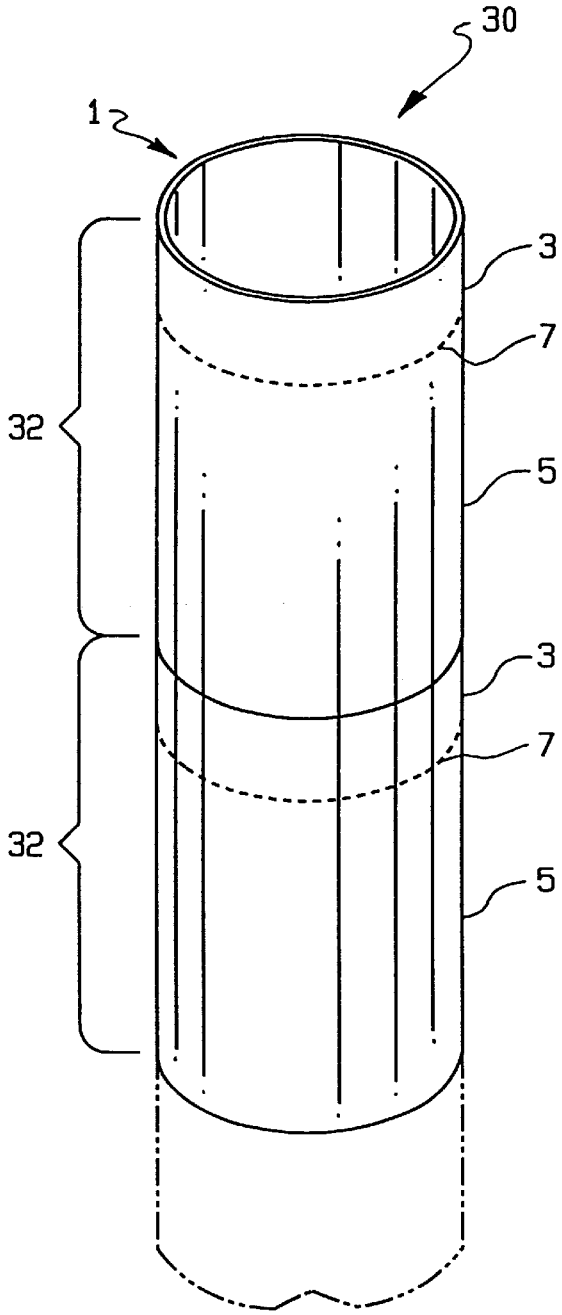
FIG. 3 shows a preferred embodiment of the wrapping material of the present invention.

In another preferred embodiment as shown in FIG. 3, a wrapping material 30 is formed with a plurality of individual sleeve segments 32. Each segment 32 has a perforation 7 thereon and is suitable for use in the present invention. Each of these individual sleeve segments 32 takes a predetermined length of the wrapping material and can be cut from the wrapping material in the process of wrapping the container 9.

FIGS. 4A, 4B and 4C illustrate the steps in a method for wrapping a container 9 according to the present invention. As shown in FIG. 4A, a sleeve 1 according to the present invention is provided having a first subsleeve 3 and a second subsleeve 5. The first and the second subsleeves 3 and 5 are connected by a perforation 7.

In carrying out the method of the present invention, sleeve 1 with a perforation 7 is placed over the container 9, as shown in FIG. 4A, with first subsleeve 3 substantially covering neck portion 11 of container 9 and second subsleeve 5 substantially covering body portion 13 of container 9. Then, as per FIG. 4B, sufficient heat is applied to the sleeve 1 in a conventional manner, causing sleeve 1 to shrink. As the sleeve 1 shrinks, the first subsleeve 3 and the second subsleeve 5 pull apart from each other. As shown in FIG. 4C, the sleeve 1 thus breaks at the perforation 7 and is separated into two independent subsleeves 3 and 5. The two subsleeves 3 and 5 continue to shrink until they become in snug surface engagement with the neck portion 11 and the body portion 13 of the container 9, respectively.

The foregoing description is intended to illustrate the present invention, and it is understood that changes and variations can be made in the foregoing embodiments without departing from the spirit and scope of the present invention which is defined in the following claims.

What is claimed is:

1. An article comprising in combination:

a container having a minor portion and a major portion; and a first subsleeve wrapping the minor portion and a second subsleeve wrapping the major portion, the first subsleeve and the second subsleeve being separated and disconnected from each other and tightly sealing the minor and the major portions respectively, wherein the first subsleeve and the second subsleeve were connected as an integral sleeve through a perforation before being subject to a heating process to apply the integral sleeve onto the container as the first and second subsleeves.

2. The article of claim 1, wherein the minor portion is a neck portion and the major portion is a body portion.

3. The article of claim 2, wherein the neck portion and the body portion of the container is cylindrical in shape.

4. The article of claim 1, wherein the first subsleeve and the second subsleeve are made of a heat-shrinkable material.

5. The article of claim 1, wherein at least one of the first subsleeve and the second subsleeve is a preprinted label.

6. A method for wrapping a container having a minor portion and a major portion comprising the steps of:

providing a heat-shrinkable sleeve having a first and a second subsleeves connected by a perforation;

placing said sleeve over the container so that the first and second subsleeves surround the minor and major portions of the container respectively; and heating the sleeve sufficiently, whereby the sleeve shrinks onto the container and breaks at the perforation to separate the first and the second subsleeves, which continue to shrink into a snug surface and tight sealing engagement with the minor portion and the major portion of the container respectively.

7. A wrapping sleeve for wrapping a container having a minor portion and a major portion comprising a first and a second subsleeves connected by a perforation, the first subsleeve being adapted to wrap the minor portion of the container and the second subsleeve being adapted to wrap the major portion of the container, wherein the first and second subsleeves are separated and discontinued from the perforation to wrap around and tightly seal the minor portion and the major portion respectively and simultaneously after heat being applied to the sleeve.

8. The wrapping sleeve of claim 7, wherein the sleeve is made of a heat-shrinkable material.

9. The wrapping sleeve of claim 8, wherein the perforation is capable of breaking upon the shrinkage of the sleeve.

10. The wrapping sleeve of claim 9, wherein the perforation is a circumferential perforation.

11. The wrapping sleeve of claim 9, wherein at least one of the first subsleeve and the second subsleeve is a pre-printed label.

12. A wrapping material comprising a plurality of sleeve segments for wrapping containers having a minor portion and a major portion, wherein each sleeve segment has a first and a second subsleeves connected by a perforation, the first subsleeve being adapted to wrap the minor portion of the container and the second subsleeve being adapted to wrap the major portion of the container, wherein the perforation is broken and the first and second subsleeves are separated to tightly and simultaneously seal the minor and major portions after the sleeve being subject to sufficient heating.

* * * * *